United States Patent [19]

Takai

[11] 4,248,038

[45] Feb. 3, 1981

[54] FALSE TWISTING METHOD AND APPARATUS FOR PRODUCING CRIMPED FILAMENT YARNS

[75] Inventor: Isao Takai, Komatsu, Japan

[73] Assignee: Oda Gosen Kogyo Kabushiki Kaisha, Komatsu, Japan

[21] Appl. No.: 78,589

[22] Filed: Sep. 19, 1979

[30] Foreign Application Priority Data

Sep. 27, 1978 [JP] Japan ..... 53-118033

[51] Int. Cl.[3] ..... D02G 1/04; D01H 7/92

[52] U.S. Cl. ..... 57/336; 57/348

[58] Field of Search ..... 57/332, 334, 336, 337, 57/348

[56] References Cited

U.S. PATENT DOCUMENTS

| | | | |
|---|---|---|---|
| 3,045,416 | 7/1962 | Ubbelohde | 57/336 X |
| 3,659,408 | 5/1972 | Burr | 57/336 X |
| 3,910,025 | 10/1975 | Takai | 57/336 |
| 4,047,373 | 9/1977 | Takai | 57/336 |
| 4,144,701 | 3/1979 | Takai et al. | 59/336 |

*Primary Examiner*—Donald Watkins

*Attorney, Agent, or Firm*—Cushman, Darby & Cushman

[57] ABSTRACT

False twisting method and apparatus of nipping type for producing crimped filament yarns, comprising two flat endless belts supported, under tension, on two pairs of pulleys, respectively, so as to run in different directions relative to each other and having work surfaces of a relatively small friction coefficient and straightly extending regions defined between their mating supporting pulleys and crossing each other at a selected angle to provide a crossing zone, while being urged, with a desired pressure of contact, against each other at this crossing zone for positively nipping thereat a filament yarn to thereby twist this filament yarn, while urging this filament yarn to advance progressively from the crossing zone.

20 Claims, 7 Drawing Figures

FALSE TWISTING METHOD AND APPARATUS FOR PRODUCING CRIMPED FILAMENT YARNS

BACKGROUND OF THE INVENTION (a) Field of the Invention

The present invention concerns processing of filament yarns, and more particularly it pertains to a method and an apparatus for performing false-twisting of filament yarns to produce crimped filament yarns.

(b) Description of the Prior Art

Conventional false-twisting methods may be divided roughly into the following two types, one of which is the so-called spindle system and the other may be termed as the friction system.

As is discussed in my U.S. Pat. No. 4,047,373 specification in detail, the known spindle system is such that the processing speed, as measured in terms of the running speed of the filament yarn, is limited to 100 m/min. ~ 150 m/min. at the most. Above this level, the filament yarns which are subjected to a false-twisting process tend to develop a number of hair or fluffs and breakage of filament yarns resulting in rejectable yarns. Also, in this spindle system, it is mandatory that the pull-out tension of the filament yarn has to be greater than the tension of the filament yarn located on the twisting zone. In order to raise productivity, the spindle which is required one for each filament yarn has to be rotated at a ultra-high speed and also the pull-out tension is required to be increased. However, with an increase in the pull-out tension which is applied to the filament yarn to be processed, there suddenly arises an increase in the number of development of hair or fluffs in the filament yarns and the number of broken yarns, so that no crimped filament yarns of the desired good quality can be obtained.

The false-twisting method of the friction type mentioned above typically employs a pair of mating rotatable frictional members such as two belts or frictionally engaging rotary rigid disks or conically-shaped rotary members having spiral row of ridges formed on their surfaces. The working surfaces of these frictional members have a large friction coefficient. A filament yarn is fed between the work surfaces of the mating running frictional members for contact therewith to be twisted thereby. While the false-twisting system relying on the surface friction of the working members allows a higher processing rate over the spindle system, the former system is accompanied by the problem that there easily develops fluffs and breakage of filament yarns with an increase in the speed of processing. Furthermore, in this friction system, the filament yarn is twisted as it is being contacted with the frictional work surfaces of the running members, and accordingly this system is poor in the processing efficiency such that there easily develops "stick slip" between the filament yarn and the high friction members, resulting in the development of portions of uneven twists which, in turn, tend to cause non-twisted portions remaining in the crimped filament yarns produced.

Moreover, in such known false-twisting systems, the number of twists or turns imparted to the filament yarn is recognized either by sampling the running filament yarn and by measuring the number of the actual turns thereof or by just an inference alleging from the tension applied to the filament yarn being twisted while giving reference to the predetermined mutual relationship between the actual turns and the tension applied onto the filament yarn at the time of twisting. Thus, in the prior art, it is difficult to make accurate control of the number of turns imparted to the filament yarns being processed.

SUMMARY OF THE INVENTION

Under the situation discussed above, the author proposed in his U.S. Pat. No. 4,047,373 a method and an apparatus of the nipping type for performing false-twisting of filament yarns at a high speed to obviate the afore-discussed drawbacks and inconveniences of the prior art. This apparatus comprises power-driven two endless belts having their respective work surfaces cross each other at a predetermined angle in pressure contact relationship to provide a crossing zone for nipping the filament yarn fed thereinto to thereby twist this filament yarn between the contacting work surfaces and at the same time to urge this filament yarn to advance from the crossing zone.

The present invention relates to an improvement of the above-mentioned method and apparatus disclosed in said U.S. Pat. No. 4,047,373.

More particularly, it is an object of the present invention to provide a method of performing false-twisting of a filament yarn by passing a filament yarn requiring to be processed, between a crossing zone of two contacting work surfaces of two running endless belts in the state that these two work surfaces are urged against each other at a desired level of contact pressure, and also to provide an apparatus for putting this method into practice, which apparatus being arranged so that this level of contact pressure can be controlled externally as desired.

Another object of the present invention is to provide a method and an apparatus as described above, which is provided with means for adjusting the level of said contact pressure between the work surfaces of the crossing belts, which means being arranged so that one of the two endless belts which is applied between two paired individual pulleys can be moved pivotably about the shaft of one of these paired two pulleys, and that this one of the two endless belts which is thus pivoted is urged against the other belt by a mere operation, externally, of an appropriate manipulating means.

Still another object of the present invention is to provide a method and an apparatus as described above, which is provided with means for tension-applying means for the respective endless belts, which means being arranged so that the two pulleys supporting a belt in each pair are urged in opposite directions so as to depart from each other elastically.

Yet another object of the present invention is to provide a method and an apparatus as described above, in which the work surfaces of the respective crossing belts have a relatively small friction coefficient.

In one aspect of the present invention, there is provided a false twisting method of nipping type for producing crimped filament yarns, comprising arranging at least two power-driven twister members having work surfaces of a relatively small friction coefficient therebetween in such manner that these work surfaces successively cross each other in a contact relationship at a selected angle to provide a crossing zone successively between these work surfaces, and feeding at least one filament yarn through said crossing zone to thereby subject said filament yarn to false twisting while nipping this filament yarn between said successively contacting work surfaces and urging, at the same time therewith this filament yarn to advance successively from said crossing zone, the improvement wherein: the crossing work surfaces can be urged against each other to establish a required level of contact pressure between these work surfaces.

According to another aspect of the present invention, there is provided a false twisting apparatus of nipping type for producing crimped filament yarns, comprising, in combination: power-driven at least one first twister member having a work surface and power-driven at least one second twister member having a work surface, both of said first and second twister members being arranged so that their work surfaces cross each other at a predetermined angle in contact relationship to provide a crossing zone for nipping at least one filament yarn fed into this crossing zone to twist this filament yarn between the contacting work surfaces and at the same time therewith to urge this filament yarn to advance from said crossing zone, and means for driving said first and second twister members so that the work surfaces of the first and second twister members run in different directions relative to each other at a predetermined angle, wherein: means is provided to urge said first twister member against said second twister member with a desired contact pressure.

Thus, it is a further object of the present invention to provide a method and an apparatus as described above, which is capable of maintaining the contact pressure between the first and the second twister members at a desired level and to maintain the tension of these twister members constant and to produce, at a high processing rate, a false-twisted filament yarn having practically no uneven portions of twists.

These and other objects as well as the features and advantages of the present invention will become more apparent by reading the following detailed description of the preferred embodiment, in conjunction with the accompanying drawings.

BRIEF DESCRIPTION OF THE DRAWINGS

Like parts are indicated by like reference numerals throughout the drawings.

DETAILED DESCRIPTION OF THE PREFERRED EMBODIMENT

The false twisting method according to one aspect of the present invention for producing crimped filament yarns comprises preparing at least two power-driven belts forming a pair, each of these belts being made with a material to have a working surface of a small surface friction coefficient between the work surfaces, said two belts being driven to run under tension at an equal speed so as to have straightly extending regions during their courses of run and in such way that these straightly extending regions cross each other at a selected angle during their run and that their work surfaces come into contact with each other at a desired contact pressure at the site of their crossing, said method further comprising feeding at least one filament yarn through the contact zone of these straightly extending regions of the running belts in such manner that this filament or filament yarns are nipped progressively between the work surfaces of these two said regions of the two belts in said pair as the belts are driven to run, thereby twisting the filament yarn or yarns and along therewith urging the filament yarn or yarns to advance progressively through the nipping zone of the running belts toward the outside of this zone.

According to another aspect of the present invention, the apparatus employed for materializing said method of the present invention comprises at least two endless belts forming a pair, each of the paired belts being made with a material to have a work surface of a small surface friction coefficient between the two work surfaces thereof. These two belts of the pair are driven to run at an equal surface velocity in such way that they have straightly extending regions, respectively, during their courses of run and that these straightly extending regions of the two paired belts cross each other at a selected angle at a desired contact pressure during their run under tension and that the work surfaces of the belts come into contact with each other at the site of their crossing. At least one thermoplastic filament yarn is fed through the contact areas of the straightly extending regions of these running belts, in such way that the filament yarn travels through the angle region defined between the straightly extending regions of the belts in their respective directions of run. The filament yarn is thus nipped progressively of its length between the successively contacting work surfaces of the running belts. As the belts run, the nipped filament yarn is twisted progressively along its length and is urged to advance successively from the nipping zone. Thus, the filament yarn is imparted a desired false twisting effect in the nipping zone and at the same time therewith it is urged to advance successively therefrom.

Figure 1:
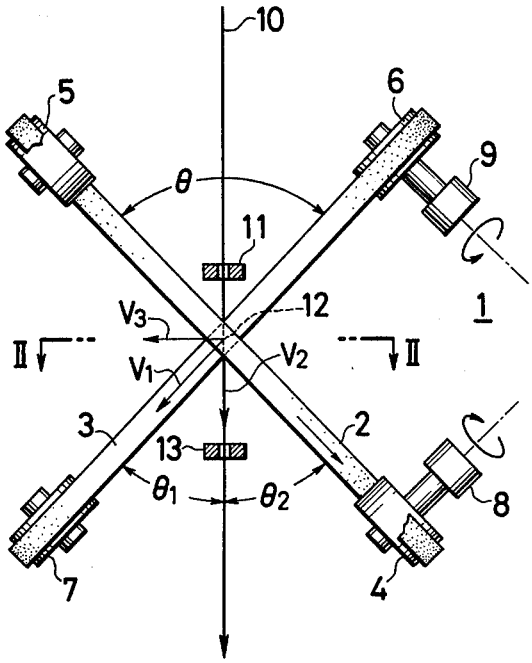
FIG. 1 is a diagrammatic illustration of an essential portion of the false-twisting apparatus which is employed in the present invention, showing the arrangement of the first and the second twister members both of which consist of endless belts.
Figure 2:
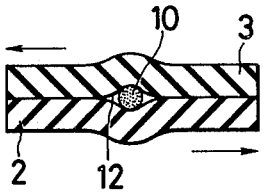
FIG. 2 is a diagrammatic enlarged sectional view of the crossing zone of the first and the second belts nipping a filament yarn therebetween, taken along the line II—II in FIG. 1.

Referring now to FIG. 1 which shows an example of the present invention, the principle of this invention will be explained in further detail. The false twisting apparatus generally indicated at 1 comprises two endless flat surfaced belts 2 and 3, forming a pair, which are made of, for example, a synthetic rubber to have work surfaces, respectively, of a small friction coefficient therebetween. These endless belts 2 and 3 are supported on pulleys 4, 5 and 6, 7, respectively, so as to provide straightly extending regions between their respective associated pulleys. These belts 2 and 3 are driven to run in different directions indicated by the arrows shown, by drive pulleys which are driven synchronously through, for example, drive means 8 and 9, respectively, which may be synchronous motors, to insure that the belts 2 and 3 are caused to run in their own directions at the same surface velocity. As shown in FIG. 2, these two endless belts 2 and 3 thus travel in different directions at a predetermined angle at the same speed while their surfaces come into contact with each other successively with a desired pressure of contact therebetween at the site of their crossing.

In the known false twisting apparatuses of the friction type, there are generally employed twister members such as belts having a large surface friction coefficient therebetween in order to enhance the twisting action of the belts. The author, contrariwise, has discovered and disclosed the finding of his discovery in his U.S. Pat. No. 4,047,373 that the use of twister members, such as belts, which have a relatively small surface friction coefficient therebetween is desirable. As stated in said U.S. Patent, the reasons therefor are as follows. In case the twister belts having highly frictional surfaces are employed, there is produced heat on the surfaces of these belts as they travel. As a result, the surfaces of the belts will begin to melt or produce smoke or to exhibit excessive stickiness so that the belts will become more and more difficult to travel smoothly. Thus, there can arise the fear that the belts come off the pulleys around which the belts are applied. As such, the belts or the twister members are selected from those materials having a relatively small surface friction coefficient. Also, it is desirable to lubricate the surfaces of the belts with water or an appropriate oil, as required.

A filament yarn 10 which may be, for example, a thermoplastic synthetic filament yarn is subjected to heating, upstream of the false twisting apparatus 1, by a heating unit not shown, and via an inlet guide 11, the filament yarn 10 is passed progressively through the region of an angle $\theta$ which is defined between the straightly extending regions of the two endless belts 2 and 3 which travel in different directions. Therefrom, the filament yarn 10 enters progressively into the twisting zone or crossing plane 12 which is defined between the contacting surfaces of the crossing straightly extending regions of the two running belts 2 and 3, where the filament yarn 10 is twisted while being nipped successively along its length between these contacting surfaces of the running belts 2 and 3, while being urged, at the same time, to be discharged successively from the nipping zone, passing through an outlet guide 13, for being now set free to be untwisted loose onto a take-up device not shown.

As shown in FIG. 1, the directions of these two endless belts 2 and 3 are set at an angle which is less than 90° relative to the direction of travel of the filament yarn 10, according to this example. Therefore, the endless belts 2 and 3 not only serve to carry out the twisting of the filament yarn 10 but also to impart this filament yarn 10 a successive advancing action which is a pull tension applied to this filament yarn. More specifically, let us now assume that the running velocity of the belts throughout the apparatus is designated as $V_1$, and that the angle defined between this belt 2 and the filament yarn 10 is designated as $\theta_1$, then the feed velocity $V_2$ which is imparted to the filament yarn 10 will be: $V_2 = V_1 \cos \theta_1$.

Same principle can be applied to the other belt 3. The false twisting apparatus 1 according to the present invention can be constructed in such way that the angle between the filament yarn 10 and the straightly extending regions of the belts 2 and 3 is allowed to be varied as required. By varying this angle to a desired value, the feed velocity of the filament yarn 10 can be varied to a desired value. It should be understood here that the respective angles $\theta_1$ and $\theta_2$ defined between the filament yarn 10 and the respective straightly extending regions of the two belts 2 and 3 most preferably are adjusted to establish the relationship $\theta_1 = \theta_2$ from such viewpoint as the stability for feeding the filament yarn. The relationship between the surface velocity of the belts 2 and 3 and the feed velocity of the filament yarn which is developed as a natural result of the running of these belts is stated in said U.S. Pat. No. 4,047,373.

Furthermore, according to the false-twisting method of the present invention, the filament yarn 10 is subjected to false twisting process in the state of this filament yarn being nipped under a desired pressure of contact between the crossing and contacting straightly extending regions of two running belts. It should be understood that, according to the present invention, unlike the prior false twisting methods utilizing contact friction system wherein it is not possible to properly know a desired number of turns imparted to the filament yarn being processed, there can be known accurate number of turns from the theoretical formulas mentioned in said U.S. Pat. No. 4,047,373.

It should be understood that, during the run of the belts 2 and 3, the positions assumed by the work surfaces of these belts would tend to fluctuate due to vibrations of the running belts and/or the vibrations of the apparatus per se. For this reason, it is desirable to maintain a continuous stable pressure contact between the straightly extending regions of these two running belts 2 and 3 during the false-twisting operation. To this end, it is desirable to impart a required pressure of contact onto the respective work surfaces of these belts at their crossing zone by positively urging one of these two belts upon another.

Figure 3:
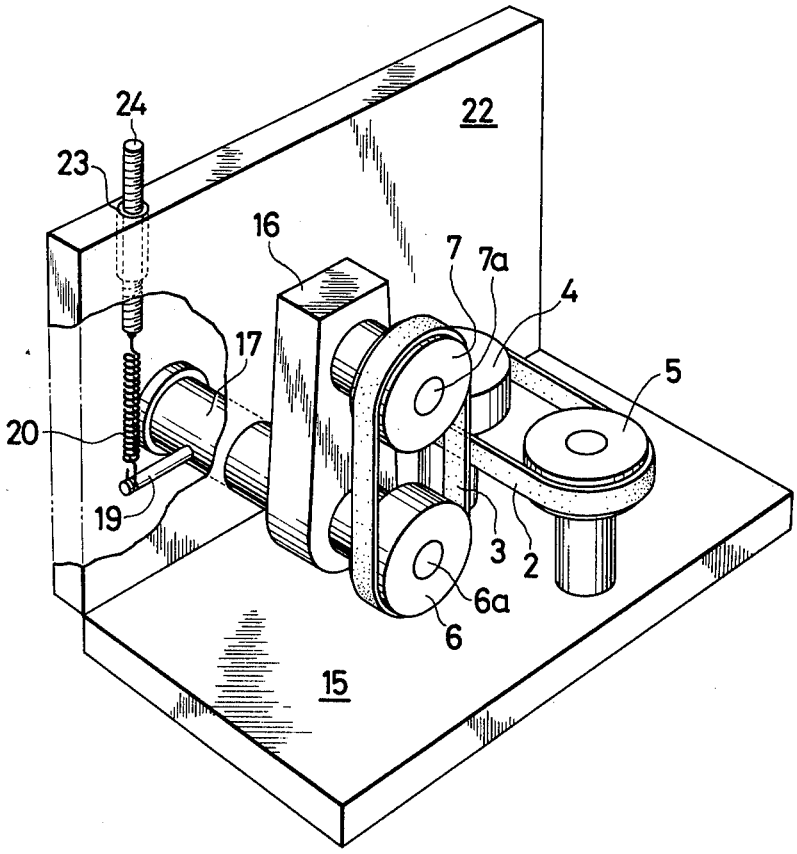
FIG. 3 is a diagrammatic explanatory perspective illustration of an embodiment of the false-twisting apparatus according to the present invention, partly broken away.
Figure 4:
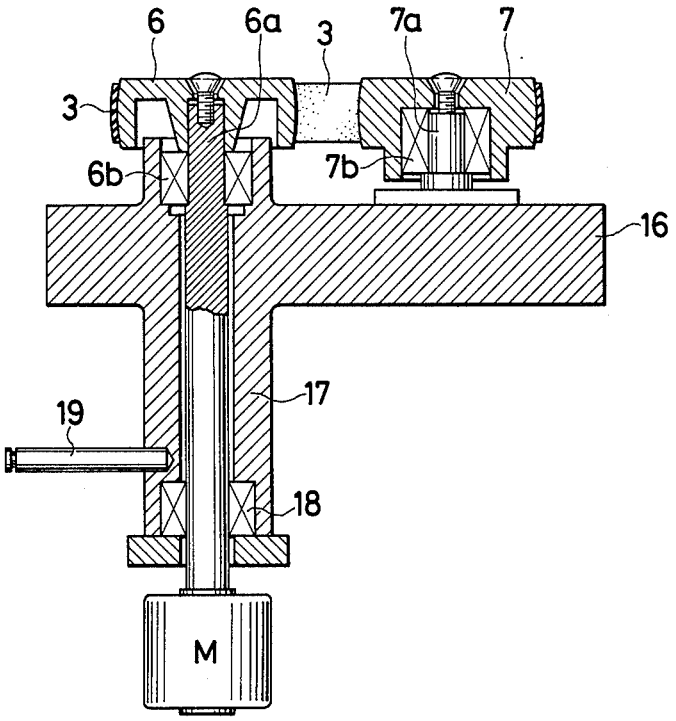
FIG. 4 is a diagrammatic explanatory sectional view of an essential portion of means for urging two pulleys, forming a pair and carrying an endless belt therearound, to make pivotal movement about the shaft of one of these two pulleys, to provide means for imparting contact pressure between the crossing belts.

An example of the mechanism for applying a desired pressure of contact onto the crossing planes of these belts 2 and 3 is shown in FIG. 3 in explanatory perspective illustration, and also in FIG. 4 which is a sectional view of an essential part thereof.

In FIG. 3, an endless belt 2 is supported on a paired pulleys 4 and 5, one which is a drive pully. These two pulleys 4 and 5 are installed on one side of a panel 15 while being supported on their shafts, respectively, which pass through said panel 15. Said drive pulley, which may be either one of the pulleys 4 and 5, is operatively coupled via its shaft to a driving means such as a synchronous motor not shown. Another endless belt 3 is supported on a pair of pulleys 6 and 7, one of which is a drive pulley. This drive pulley, which in this example is the pulley 6, is supported on its shaft **6*a* via a bearing 6*b*. This shaft 6*a* is passed through a pivotable cylindrical hollow sleeve 17 to be coupled to a driving means such as a synchronous motor M. The pivotable cylindrical sleeve 17, in turn, is fixed at its one end to a pivotable frame 16 to provide an integral member for pivotable movement with the pivotable frame 16. The cylindrical sleeve 17 is concentric with the shaft 6*a* of the pulley 6. This cylindrical hollow sleeve 17 is carried rotatably on a bearing 18 after passing through a panel 22. The belt 3 which is applied around the paired pulleys 6 and 7 is arranged so that its straightly extending region is positioned so as to cross the other belt 2 at a desired angle. A manipulation rod 19 extends outwardly from an end portion of the cylindrical hollow sleeve 17. This manipulation rod 19 is assigned for rotating said cylindrical hollow sleeve 17 for causing pivotal movement of the pivotable frame 16 which is integral with the sleeve 17. At the free end of the manipulation rod 19 is fixed one end of a spring means 20 which acts normally to pull the cylindrical hollow sleeve 17 so as to rotate clockwise in FIG. 3. The other end of this spring means 20 is fixed to an end of an adjusting bolt 24 which is threaded through a threaded hole 23 which, in turn, is formed through the panel 22 in such way that its operating end portion extends outwardly beyond the edge of one side of the panel 22. As will be seen in FIG. 4, the pulley 7** is mounted, for free rotation, on its shaft *7a* via a bearing *7b*. This shaft *7a* is fixed to one surface of the pivotable frame 16. The pivotable frame 16, the cylindrical hollow sleeve 17, the bearing 18, the manipulation rod 19, the spring means 20 and the adjusting bolt 24 jointly constitute means for producing a pressure of contact between the straightly extending regions of the belts 2 and 3.

With the aforesaid arrangement of the means for producing a pressure of contact between the belts 2 and 3, it will be understood that, by rotating the adjusting bolt 24 in such direction as to emerge more outwardly beyond said edge of the panel 22, the spring means 20 is forced to produce a greater pulling force. Accordingly, the pivotable frame 16 is caused to ratate, with a greater force than that mentioned just above, in clockwise direction in FIG. 3. As this pivotable frame 16 makes such pivotal movement in clockwise direction, the straightly extending region of the belt 3 which directly faces the straightly extending region of the other belt 2 is caused to approach more closely toward the straightly extending region of this latter belt 2 due to the pivotal movement of the paired pulleys 6 and 7 via their respective shafts *6a* and *7b* and via the cylindrical sleeve 17 fixed to the pivotable frame 16. As a result, the pressure of contact between the straightly extending regions of these two endless belts 3 and 2 will increase. Contrariwise, as the adjusting bolt 24 is rotated so as to make a deeper threaded engagement into the threaded hole 23 of the panel 22, the pulling force of the spring means 20 will be caused to become smaller, and as a result the degree of the contact pressure between the respective straightly extending regions of the belts 2 and 3 will become smaller accordingly.

With such arrangement of the means for producing a pressure of contact between the belts 2 and 3 as described above, it will be understood that, in case it is intended to displace the respective straightly extending regions of the belts 2 and 3 which have been in contact with each other, away from each other in order to, for example, pass a filament yarn through the crossing zone of these two facing regions of the belts, it is only necessary to operate the adjusting bolt 24 so as to rotate the pivotable frame 16 counter-clockwise against the force of the spring means 20. Whereupon, these two straightly extending regions of the belts 2 and 3 can be easily displaced away from each other. Thus, this arrangement is quite convenient from the viewpoint of such operation.

For further convenience, sake, it is desirable to arrange said means for producing a pressure contact in such way that, when the pivotable frame 16 is manually rotated in the counter-clockwise direction in FIG. 3. against the force of the spring means 20, these two belts 2 and 3 can be locked at their any arbitrary positions of being parted away from each other. By so arranging, the operation of passing a filament yarn 10 through the twisting apparatus 1 will be made much easier.

Figure 5:
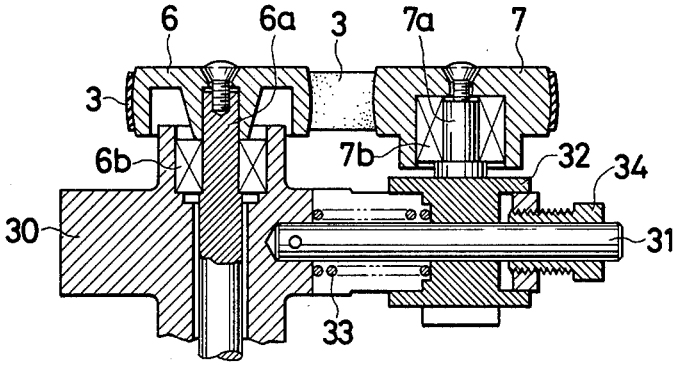
FIG. 5 is a diagrammatic explanatory sectional view of an essential portion of mechanism for urging two pulleys, forming a pair, away from each other by an elastic member, to provide means to maintain tension of a belt carried around these pulleys.

Next, description will hereunder be made, by referring to FIG. 5, of a mechanism for urging the respective paired pulleys away from each other in each pair, to always maintain the respective belts 2 and 3 in their tensioned state. As will be understood, FIG. 5 illustrates only the essential portion of this mechanism. This mechanism will be explained only with respect to the paired pulleys 6 and 7, on which the belt 3 is supported, since the principle is identical with respect to the other pair of pulleys 4 and 5 which support the other belt 2.

The combination of the pulley 6 with its shaft *6a* and pivotable cylindrical hollow sleeve 17 is mounted through a supporting pedestal or sleeve 30. One end portion of a horizontal rod 31 is fixed, by appropriate means, to this supporting pedestal or sleeve 30 so as to extend therefrom perpendicular to the axis of the shaft of the pulley 6. On the other hand, the shaft *7a* of the other pulley 7 in the pair is mounted on another supporting pedestal 32 which, in turn, is mounted slidably on said horizontal rod 31. A spring means 33 is mounted around said horizontal rod 31 between the two supporting pedestals 30 and 32, to urge these two supporting pedestals 30 and 32 to part away from each other. At the free end portion of the horizontal rod 31, there is provided a stopper 34 to prevent the slidable supporting pedestal 32 of the pulley 7 from coming off the horizontal rod 31. With this arrangement of the belt-tensioning means, the belt 3 which is applied around the paire pulleys 6 and 7 is conveniently maintained always in its tensioned state.

Figure 6:
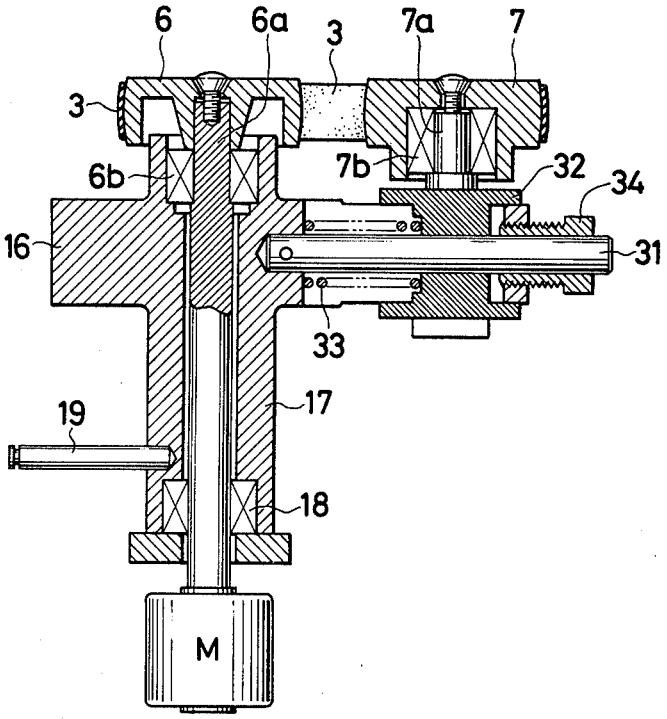
FIG. 6 is a diagrammatic explanatory sectional view of a pair of pulleys supporting an endless belt, which is provided with a combination of contact-pressure producing means and belt-tension maintaining means.

The afore-mentioned means for producing a pressure of contact between the straightly extending regions of the two crossing belts 2 and 3, and the means for maintaining the tension of each of the two belts may be provided either in combination or in such way that either one pair of pulleys carrying a belt thereon is provided with only the belt-tension maintaining means and that the other pair of pulleys carrying another belt is provided with both of the contact pressure producing means and the belt-tension maintaining means. FIG. 6 shows the instance wherein the pair of pulleys 6 and 7 supporting the belt 3 is provided with these two kinds of means. In this instance, needless to say, the other pair of pulleys 4 and 5 supporting the belt 2 is not provided with these two means jointly, but only with the belt-tension maintaining means, though not expressly shown in the drawings. In any case, it is desirable that each pair of pulleys 4, 5 and 6, 7 is provided with the belt-tension maintaining means to always keep the belt in its tensioned state to obtain a better and stable result of false-twisting operation.

Next, description will be made of the relationship between the pressure of contact between the straightly extending regions of the respective belts 2 and 3 and the number of turns imparted to a filament yarn 10 as a result of false twisting operation conducted by the use of the apparatus of the type as shown in FIG. 3.

EXAMPLE

Diameter of drive pulleys 44 and 6:54 mm
Diameter of idle pulleys 5 and 7:38 mm Distance between pulleys 4 and 5 and between pulleys 6 and 7:53 mm Belts 2 and 3:

material with which they are made: synthetic rubber thickness:1 mm width:12 mm circumferential length:250 mm Running speed of belts 2 and 3:577.0 m/min.

Angle defined by straightly extending regions of belts 2 and 3:$\theta = 120°$ Velocity of filament yarn (peripheral velocity of delivery roller):400 m/min.

First OFF (over-feed):−0.99%

Wind OF (over-feed):+7.0%

Filament yarn: drawn polyester filament yarn of 75 de/36 (diameter: 0.08 mm)

A spring member having a spring force of 14 kg is applied between the drive pulley and the idle pulley. While varying the pressure of contact between the surfaces of contact of the belts 2 and 3, the variations of the number of turns per meter (T/m) are checked. In this test, the number of turns (T/m) is calculated in accordance with the following formula:

$$T/m = T_0 \times (100/l_1)$$

wherein:

$T_0$ represents the number of turns of untwisting counted of a length $l_0$ (cm) of a running filament yarn sampled in its twisted state; and $l_1$ represents the length of the untwisted filament yarn from the sampled length $l_0$ of that twisted filament yarn mentioned above.

Figure 7:
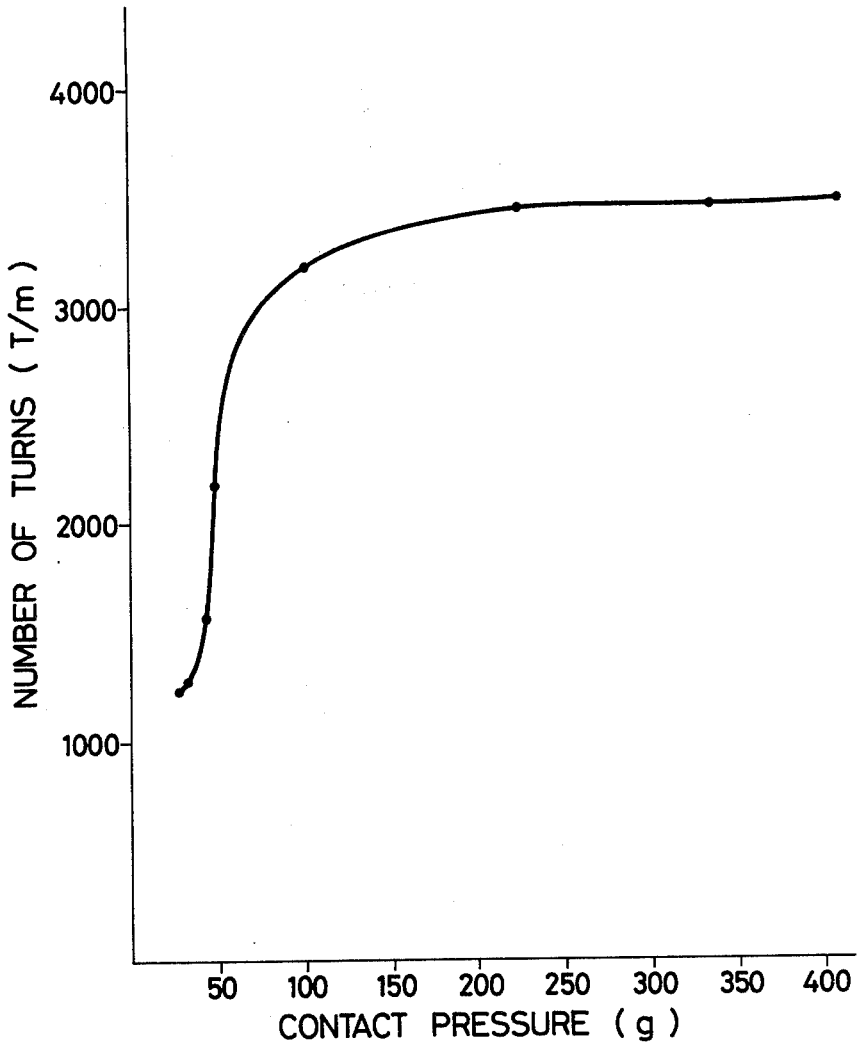
FIG. 7 is a chart for showing the relationship between the contact pressure of belts and the number of turns imparted to a filament yarn to be processed.

This test is conducted in such manner that the check is started when the pressure of contact between the straightly extending regions in the crossing zone of the belts has been increased up to a point just before these respective belts come off their pulleys, while gradually and progressively decreasing the degree of this contact pressure in a plurality of stages. At each stage or level of the pressure of contact, the number of turns is counted 10 times, i.e. for ten sampled lengths of filament yarn per same contact pressure. The result is shown in the following Table 1 and also in the chart of FIG. 7 which shows mean number of turns. It should be understood that, in Table 1, the percentage of variance is obtained by dividing, by the mean value $\bar{x}$ of the numbers of turns, a mean of the absolute value $|\bar{x}-x_n|$ of the differences between said mean value $\bar{x}$ of the numbers of turns and the respective numbers of turns $x_n$, i.e.

$$\frac{1}{10} \times \sum_{n=1}^{10} |\bar{x} - x_n|,$$

and then multiplying the result by 100.

TABLE 1

| Contact pressure of belts (g) | | 413 | 336 | 226 | 106.6 | 48.0 | 46.6 | 34.6 | 29.3 | 27.2 |
|---|---|---|---|---|---|---|---|---|---|---|
| No. of turns | $x_1$ | 3501 | 3496 | 3433 | 3295 | 2658 | 505 | 1054 | 1186 | 1509 |
| | $x_2$ | 3510 | 3481 | 3437 | 3236 | 2811 | 1849 | 1346 | 1783 | 1553 |
| | $x_3$ | 3475 | 3465 | 3413 | 3180 | 2302 | 536 | 1228 | 1380 | 1542 |
| | $x_4$ | 3487 | 3424 | 3412 | 3188 | 2019 | 2321 | 857 | 1182 | 1481 |
| | $x_5$ | 3511 | 3498 | 3457 | 3217 | 2208 | 1156 | 2049 | 1642 | 1215 |
| | $x_6$ | 3449 | 3489 | 3497 | 3126 | 2023 | 2496 | 1297 | 986 | 1227 |
| | $x_7$ | 3481 | 3436 | 3479 | 3105 | 2649 | 2312 | 1200 | 1220 | 802 |
| | $x_8$ | 3467 | 3472 | 3452 | 3232 | 2197 | 2505 | 1024 | 980 | 1935 |
| | $x_9$ | 3507 | 3439 | 3454 | 3216 | 1801 | 1145 | 886 | 968 | 2053 |
| | $x_{10}$ | 3491 | 3462 | 3410 | 3165 | 1168 | 614 | 1644 | 1000 | 2127 |
| Mean no. of turns $\bar{x}$ | | 3488 | 3466 | 3444 | 3196 | 2184 | 1544 | 1258 | 1232 | 1544 |
| Variance (%) | | 0.46 | 0.61 | 0.68 | 1.35 | 15.78 | 48.75 | 20.69 | 17.95 | 19.30 |

As will be noted from the result of test show in Table 1, in the range of pressure of contact between the surfaces of contact of the belts greater than a certain value, which in this example is 106.6 g, and specifically in the range above 226 g, there is noted no great variations in the number of turns, and also the percentage of variance is small. However, as the pressure of contact at the contact surfaces of the belts becomes smaller than that value mentioned above, the number of turns suddenly becomes small, whereas the percentage of variance becomes great contrariwise. This may be considered to be due to the fact that, in case the pressure of contact between the straightly extending regions of the belts is not sufficiently great, the contact between these regions of the belts becomes unstable due to reasons such as the vibrations of the running belts and the vibrations of the apparatus per se, and because, accordingly there occurs frequent slipping between the filament yarn and the surfaces of the belts at the crossing zone of belts.

In particular, in the above-mentioned test, it is not possible to impart twists to filament yarns at a pressure of contact smaller than 27.2 g. This may be considered to be attributable to the fact that, under a small pressure of contact, the straightly extending regions of the respective belts often detach from each other temporarily due to such reasons as the vibrations of these belts.

From such result of test as mentioned above, it has been found that the pressure of contact between the surfaces of belts at the crossing zone requires to be 100 g or greater, and desirably 200 g or greater.

As stated above, according to the present invention, it has been made possible to carry out extremely stable false twisting of filament yarns by passing a filament yarn through the crossing zone of two running belts, under the conditions that the crossing work surfaces of these belts are not merely brought into contact with each other, but they are positively urged against each other at a pressure of contact of 100 g or greater, desirably 200 g or greater.

Also, according to the present invention, one of the pair of belts is arranged to be pivotable about the shaft of one of its paired pulleys which support this belt. This arrangement greatly facilitates the disengagement and parting of the belts away from each other when required, so that the operation such as application of a filament yarn through the processing parts of the apparatus is made markedly simple and easy.

The angle with which the straightly extending regions of the pair of belts cross each other may be varied by merely altering the angle between the two panels 15 and 22 on which the belt-supporting pulleys 4 and 5 and the belt-supporting pulleys 6 and 7, as pairs, are provided, respectively. Such alteration of the angle between these two panels 15 and 22 may be performed by a hinge means mounted on the portions of the two panels where their respective edges produce a corner. Such hinge means desirably is designed so as to be able to perform the control of the angle and also to lock the two panels at a desired angle. For the sake of simplicity, such hinge means is not illustrated in the drawings.

As the mechanism for varying the pressure of contact between the crossing two straightly extending regions of the pair of belts, there may be various modifications of the mechanism shown in FIG. 3 which features that one of the two belts is pivoted about the shaft of one of its associated paired pulleys supporting this belt. One such example of modifications may be the arrangement that both of the pulleys supporting one of the two belts are provided on a slidable panel, and that this slidable panel is moved in such way that this belt is caused to urge against the other one of the pair of belts at a constant force by means of, for example, a spring member. Another such modification may be to apply a certain constant pressure force onto a belt by the use of a weight or like member, instead of the spring member.

What is claimed is:

1. A false twisting method of nipping type for producing crimped filament yarns, comprising arranging at least two power-driven twister members having work surfaces of a relatively small friction coefficient therebetween in such manner that these work surfaces successively cross each other in contact relationship at a selected angle to provide a crossing zone successively between these work surfaces, and feeding at least one filament yarn through said crossing zone to thereby subject said filament yarn to false twisting while nipping this filament yarn between said successively contacting work surfaces and urging, at the same time therewith, this filament yarn to advance successively from said crossing zone, the improvement wherein: said nipping is performed by releasably urging said twister members, which form said crossing zone, against each other so that the pressure of contact between said work surfaces of these twister members gains a desired value.

2. A false twisting method according to claim 1, wherein: said twister members are driven so that their work surfaces run at a same surface speed.

3. A false twisting method according to claim 1, wherein: said at least two power-driven twister members are endless belts made of a synthetic rubber and having substantially flat work surfaces and applied to two sets of power-driven pulleys to provide straightly extending regions between each set of these pulleys.

4. A false twisting method according to claim 1, wherein: said pressure of contact between the work surfaces of the twister members is set at 100 g or greater.

5. A false twisting method according to claim 1, wherein: said pressure of contact between the work surfaces of the twister members is set at 200 g or greater.

6. A false twisting method according to claim 2, wherein: said at least two power-driven twister members are endless belts made of synthetic rubber and having substantially flat work surfaces and applied to two sets of power-driven pulleys to provide straightly extending regions between each set of these pulleys.

7. A false twisting method according to claim 6, wherein: said pressure of contact between the work surfaces of the endless belts is set at 100 g or greater.

8. A false twisting method according to claim 6, wherein: said pressure of contact between the work surfaces of the endless belts is set at 200 g or greater.

9. A false twisting method according to claim 1, wherein: said twister members are held in tensioned state.

10. A false twisting method according to claim 6, wherein: said endless belts are held in tensioned state.

11. A false twisting apparatus of nipping type for producing crimped filament yarns, comprising:

power-driven at least one first twister member having a work surface and power-driven at least one second twister member having a work surface, both of said first and second twister members being arranged so that their work surfaces cross each other at a selected angle in contact relationship to provide a crossing zone for nipping at least one filament yarn fed into this crossing zone to twist this filament yarn between the contacting work surfaces and at the same time therewith to urge this filament yarn to advance from said crossing zone, and means for driving said first and second twister members so that the work surfaces of the first and second twister members run in different directions relative to each other at a selected angle, the improvement wherein:

said apparatus further includes means for releasably producing a desired pressure of contact between said work surfaces of the first and second twister members in said crossing zone.

12. A false twisting apparatus according to claim 11, wherein: said driving of said first and second twister members is conducted so that the respective work surfaces run at a same surface speed.

13. A false twisting apparatus according to claim 11, wherein: said at least one first twister member is at least one endless belt made of a synthetic rubber and having a substantially flat work surface and applied between two power-driven pulleys to provide a straightly extending region therebetween, and said at least one second twister member is at least one endless belt made of a synthetic rubber and having a substantially flat work surface and applied between another two power-driven pulleys to provide a straightly extending region therebetween.

14. A false twisting apparatus according to claim 11, wherein: said work surfaces of the first and second twister members are made with a material having a relatively small friction coefficient.

15. A false twisting apparatus according to claim 13, wherein: said endless belt of each of said first and second twister members is made with a material having a relatively small friction coefficient.

16. A false twisting apparatus according to claim 11, wherein: said means for releasably producing a desired pressure of contact is means for releasably urging said twister members, which form said crossing zone, against each other so that the pressure of contact between said work surfaces of these twister members gains a desired value.

17. A false twisting apparatus according to claim 13, wherein: said means for releasably producing a desired pressure of contact is means for releasably urging said endless belts of said first and second twister members, which form said crossing zone, against each other so that the pressure of contact between the work surfaces of these endless belts gains a desired value.

18. A false twisting apparatus according to claim 11, wherein:

said means for driving said first and second twister members are comprised of two pairs of pulleys arranged so that the pulleys in each pair support one of said first and second twister members therearound and that the shaft of one of the pulleys in each pair is power-driven in synchronous speed relative to each other, and said means for releasably producing a desired pressure of contact comprises:

a sleeve means rotatably supporting the shaft of one of the pulleys in said one of the pairs, a frame means extending from said sleeve means and forming an integral member with said sleeve means and supporting the shaft of the other of the pulleys in said one of the pairs, and means for rotating said sleeve means about the shaft of said one of the pulleys in said one of the pairs, whereby said first twister member and said second twister member are urged against each other by a rotation of said means for rotating said sleeve means to produce a desired pressure of contact between said work surfaces of the first and second twister members in said crossing zone.

19. A false twisting apparatus according to claim 11, further comprising:

tensioning means for independently maintaining each of said first and second twister members in tension.

20. A false twisting apparatus according to claim 19, wherein: said tensioning means comprises:

means provided on said frame member of said sleeve means for allowing one of the pulleys of the pair to make slidable movement, via its shaft, relative to the other of these pulleys of said pair, and elastic means provided between the respective shafts of these pulleys in each pair for elastically urging these pulleys away from each other by said slidable movement.

* * * * *